US010190582B2

(12) United States Patent
Zhang et al.

(10) Patent No.: US 10,190,582 B2
(45) Date of Patent: Jan. 29, 2019

(54) SYSTEMS AND METHODS FOR COLLECTING HIGH FREQUENCY DATA ASSOCIATED WITH A PUMP BY UTILIZING AN FPGA CONTROLLER

(71) Applicant: Caterpillar Inc., Peoria, IL (US)

(72) Inventors: Yanchai Zhang, Dunlap, IL (US); Vijay Janardhan, Dunlap, IL (US); Maurice Dust, Edwards, IL (US)

(73) Assignee: Caterpillar Inc., Deerfield, IL (US)

( * ) Notice: Subject to any disclaimer, the term of this patent is extended or adjusted under 35 U.S.C. 154(b) by 618 days.

(21) Appl. No.: 14/925,704

(22) Filed: Oct. 28, 2015

(65) Prior Publication Data

US 2017/0122308 A1 May 4, 2017

(51) Int. Cl.
*F04B 51/00* (2006.01)
*F04B 49/06* (2006.01)

(52) U.S. Cl.
CPC ..... *F04B 51/00* (2013.01); *F04B 49/06* (2013.01)

(58) Field of Classification Search
CPC ..... F04B 51/00; E21B 43/26
See application file for complete search history.

(56) References Cited

U.S. PATENT DOCUMENTS 5,720,598 A * 2/1998 de Chizzelle ..... F04B 51/00 417/53
7,013,223 B1 * 3/2006 Zhang ..... F02M 65/003 417/53
7,690,565 B2 4/2010 Faoro
8,146,416 B2 * 4/2012 Pisio ..... E21B 43/26 73/152.51
8,204,717 B2 6/2012 McLaughlin
8,210,257 B2 7/2012 Dusterhoft
8,615,660 B1 12/2013 Selman
2013/0175030 A1 * 7/2013 Ige ..... E21B 43/128 166/250.15
2014/0151035 A1 6/2014 Cohen
2015/0218888 A1 8/2015 Schonberger

FOREIGN PATENT DOCUMENTS

CN 101414171 A 4/2009
CN 201556094 U 8/2010
CN 103412522 A 11/2013

* cited by examiner

*Primary Examiner* — Erika J Villaluna
(74) *Attorney, Agent, or Firm* — Miller, Matthias & Hull

(57) ABSTRACT

A system for monitoring a pump, while the pump operates at a worksite, is disclosed. The system includes one or more sensors, wherein each of the one or more sensors is associated with the pump and is configured to collect high frequency data associated with the pump. The system further includes a field-programmable gate array (FPGA) controller configured to receive the high frequency data from the one or more sensors and is also configured to generate low frequency data based on the high frequency data. The system further includes a low frequency controller configured to receive the low frequency data from the FPGA controller and configured to transmit the low frequency data to a monitor.

19 Claims, 5 Drawing Sheets

SYSTEMS AND METHODS FOR COLLECTING HIGH FREQUENCY DATA ASSOCIATED WITH A PUMP BY UTILIZING AN FPGA CONTROLLER

TECHNICAL FIELD OF THE DISCLOSURE

The present disclosure generally relates to systems and methods for monitoring conditions of a pump at a worksite and, more particularly, relates to systems and methods for monitoring a pump by converting frequency domain data using a field-programmable gate array (FPGA) controller.

BACKGROUND OF THE DISCLOSURE

Pumps used for hydraulic fracturing, or "fracking," operations are, generally, configured to pressurize and transfer a fracturing fluid into a downhole wellbore to create cracks in deep-rock formations under the earth's surface. As such, the pump is a vital piece in the fracking operation and it is imperative that it works at optimal capacity. To this end, it is important that a user, either on the worksite or remotely, consistently monitors health conditions of the pump during fracking operations.

In many such pumps, various components are included that may be subject to high working pressures during a fracking operation. As such, these components (e.g., suction manifolds, discharge manifolds, cylinders, etc.) may be at risk of damage or, in some instances, failure. Overall health and performance of the pump is reliant on the health of these pump components, as faults in pump components may lead to leakage within the pump and, in some circumstances, may cause inefficient operation of the pump or overall failure of pump operations on the fracking site.

However, such faults can be avoided and healthy operation of the pump may be maintained by monitoring the health of the pump. In an example health monitoring system disclosed in U.S. patent application Ser. No. 14/571,758 ("System for Detecting Leakage in a Pump Used in Hydraulic Fracturing"), component failure in a pump can be either predicted or detected based on data collected by a health monitoring system. More specifically, the systems of the '758 application collect data from various pressure sensors located at or proximate to specific components of the pump and transmit said data to a controller, which uses the data to determine pump health. Such systems may detect leakage at various components and may provide general health information to a party which is monitoring the pump.

However, such systems, generally, collect low frequency data using a controller. In pump operations, pressure sensors, or any other sensor associated with the pump, may be capable of providing high frequency data that may be useful in monitoring the health of the pump. Therefore, systems and methods for monitoring a pump which can monitor high frequency data to provide health data with greater accuracy are desired.

SUMMARY OF THE DISCLOSURE

In accordance with one aspect of the present disclosure, a system for monitoring a pump, while the pump operates at a worksite, is disclosed. The system may include one or more sensors, wherein each of the one or more sensors is associated with the pump and is configured to collect high frequency data associated with the pump. The system may further include a field-programmable gate array (FPGA) controller configured to receive the high frequency data from the one or more sensors and may be configured to generate low frequency data based on the high frequency data. The system may further include a low frequency controller configured to receive the low frequency data from the FPGA controller and may be configured to transmit the low frequency data to a monitor.

In accordance with another aspect of the disclosure, an FPGA electronic control module (ECM) operatively associated with a pump, the pump operating on a hydraulic fracturing worksite, is disclosed. The FPGA ECM may include an input interface for receiving input from one or more sensors, each of the one or more sensors being associated with the pump and configured to collect high frequency data associated with the pump. The FPGA ECM may further include a processor configured to receive the high frequency data from the input interface and generate low frequency data by utilizing frequency domain analysis. The FPGA ECM may further include an output interface for receiving the low frequency data from the processor and transmitting the low frequency data to a monitor.

In accordance with yet another aspect of the disclosure, a method for monitoring a pump, while the pump operates at a worksite, is disclosed. The method may include collecting high frequency data associated with the pump using one or more sensors. The method may further include receiving the high frequency data, by a FPGA controller, from the one or more sensors. The method may further include generating low frequency data, by the FPGA controller, based on the high frequency data. The method may further include receiving the low frequency data, by a telematics controller, from the FPGA controller. The method may further include transmitting the low frequency data, by one or both of the telematics controller and the FPGA controller, to a monitor.

Other features and advantages of the disclosed systems and principles will become apparent from reading the following detailed disclosure in conjunction with the included drawing figures.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION OF THE DISCLOSURE

Figure 1:
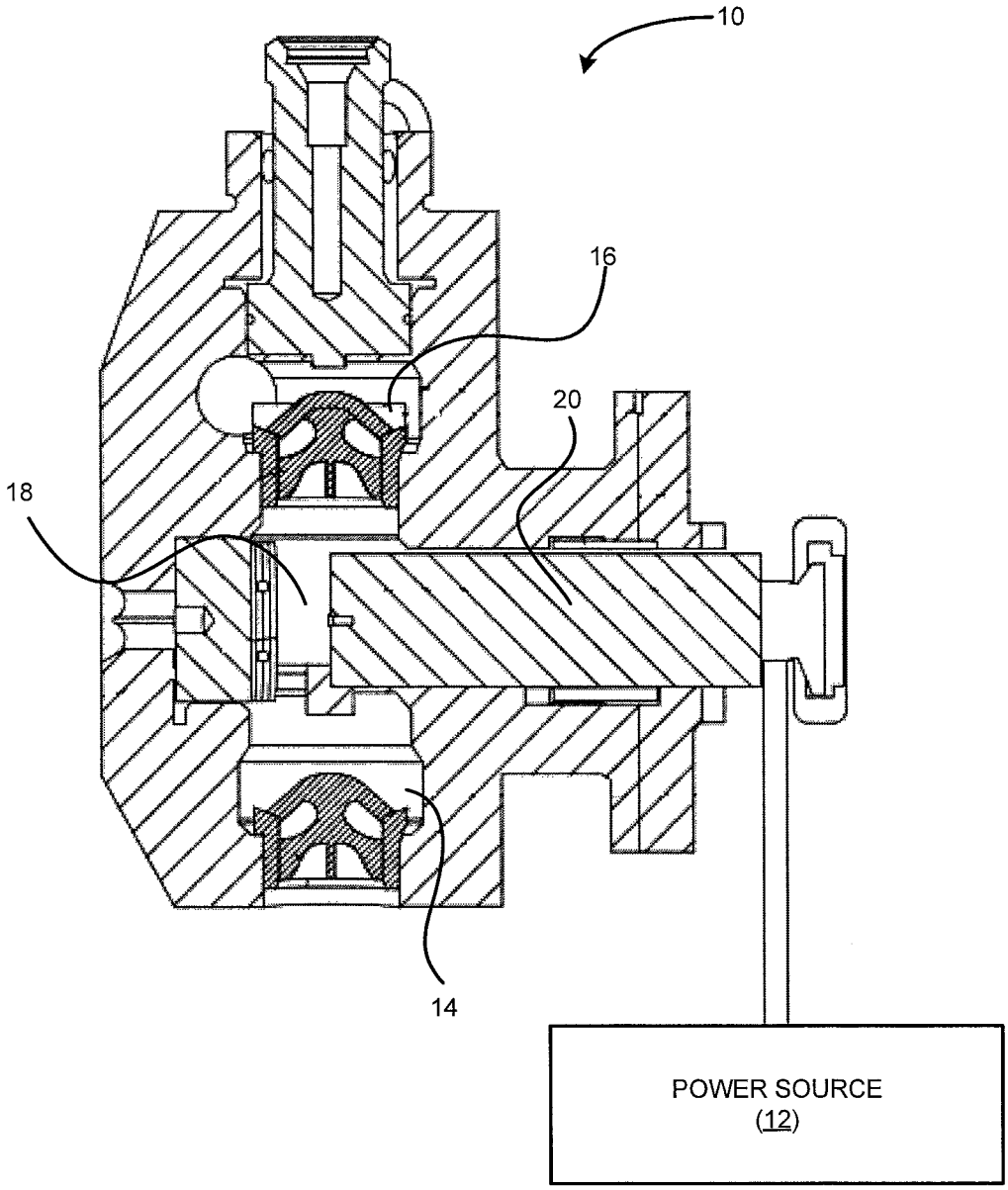
FIG. 1 is a cross-sectional view of an exemplary pump which may be used for hydraulic fracturing, in accordance with the present disclosure.
Figure 2:
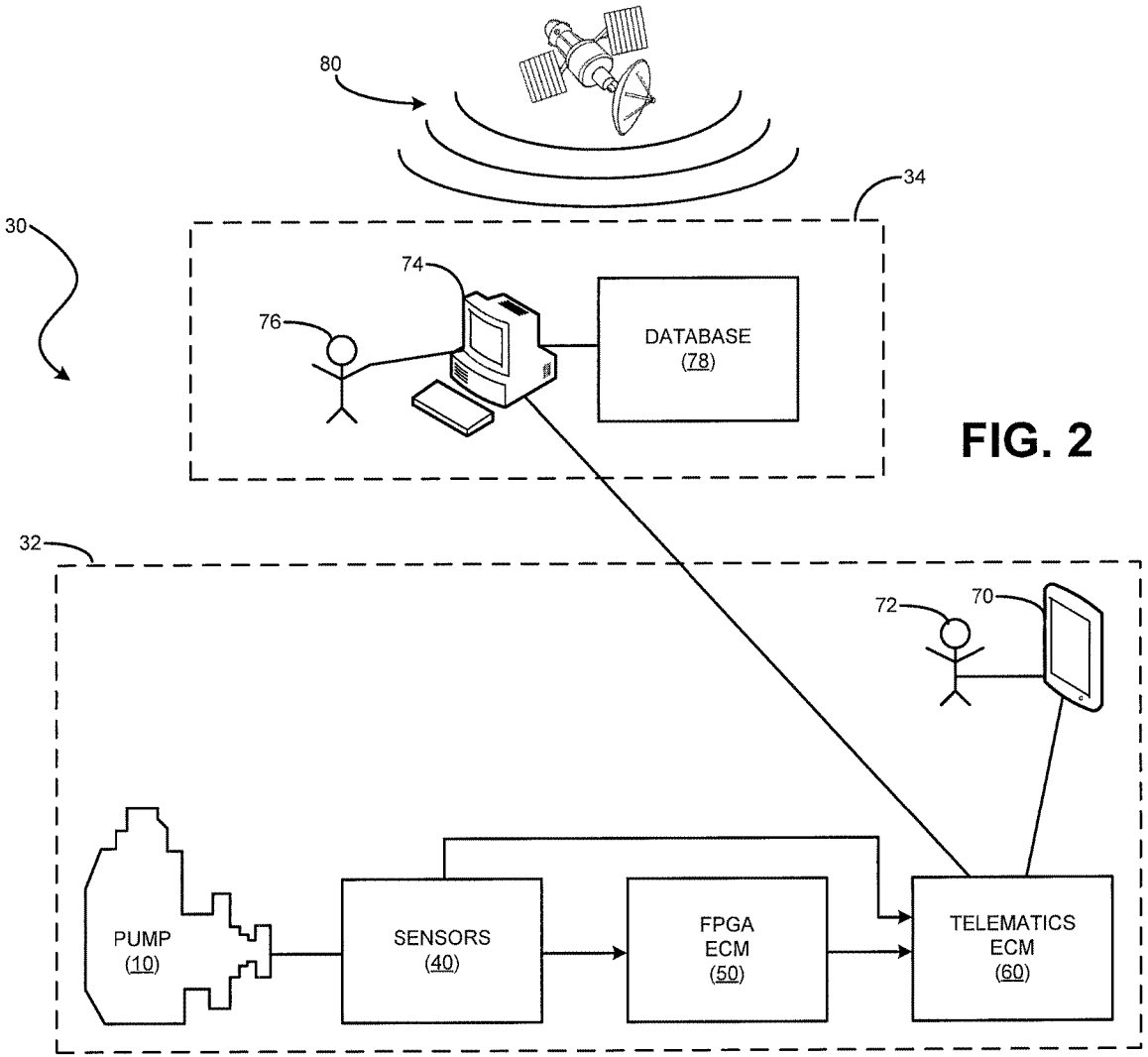
FIG. 2 is a schematic diagram of an exemplary system for monitoring health of the pump of FIG. 1, in accordance with an embodiment of the present disclosure.

Turning now to the drawings and with specific reference to FIG. 1, a pump 10, which may be used in a hydraulic fracturing, or "fracking," operation, is shown in a cross-sectional depiction. As shown, the pump 10 may be driven by a power source 12, which may include, but is not limited to including, a motor, an engine, an engine with a transmission, a diesel engine, a gas turbine engine, a hybrid-electric engine, an electric engine, and/or any other type of power source for driving a pump as known to one having ordinary skill in the art.

The pump 10 may include a suction manifold 14, a discharge manifold 16, and one or more cylinders 18 located between the suction manifold 14 and the discharge manifold 16. While only one cylinder 18 is depicted and visible in the cross-sectional view of FIG. 1, the pump 10 may include any suitable number of cylinders 18. The cylinders 18 may include reciprocating pistons 20, which may pressurize fracking fluids.

During operation of the pump 10, the suction manifold 14 may be configured to receive a fracking fluid, which may be mixed in a blender (not shown) prior to being received by the suction manifold 14. The received fracking fluid may then be pressurized by the piston 20, within the cylinder 18. The discharge manifold 16 is configured to output pressurized fracking fluid from the cylinder 18 and into a wellbore for fracturing deep-rock formations located under the earth's surface.

Referring now to FIGS. 2-5, and with continued reference to FIG. 1, a system 30 for monitoring the pump 10 at a worksite 32 (e.g., a worksite for hydraulic fracturing), is shown in a schematic depiction. The system 30 may include one or more sensors 40 configured to collect data from the pump 10 and various components of the pump 10 (e.g., the suction manifold 14, the discharge manifold 16, the cylinder 18, etc.). The data collected by the sensors 40 may include high frequency data. "High frequency data" may be defined herein as data that includes useful information that is collected in and exists in the time domain and has a high frequency or sampling rate (e.g., the frequency or sampling rate may be between 10 kilohertz and 25 kilohertz). High frequency data may be converted in to "low frequency data," which may be defined herein as data existing in and read in the time domain and having a lower frequency or sampling rate (e.g., the frequency or sampling rate may be between 0 hertz and 100 hertz).

Figure 3:
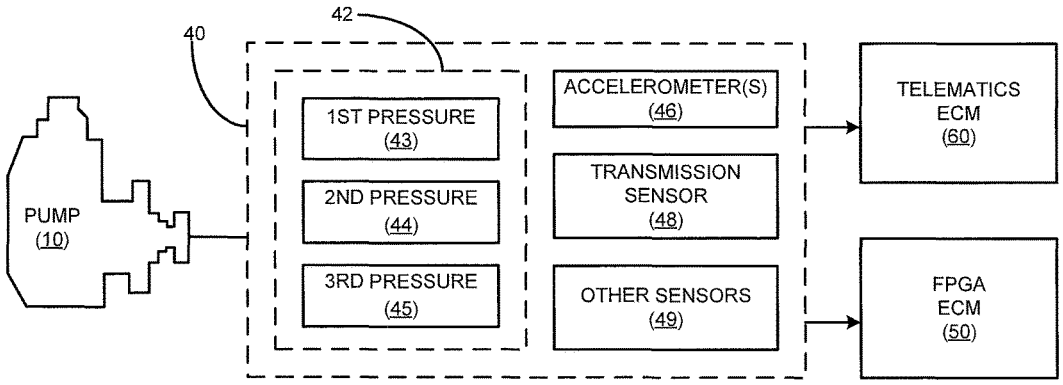
FIG. 3 is a schematic diagram of exemplary sensors for use with the system of FIG. 2, in accordance with the embodiment of FIG. 2 and the present disclosure.

The sensors 40 are depicted in greater, schematic detail in FIG. 3 and may include one or more pressure sensors 42. The pressure sensors 42 may include, but are certainly not limited to including, a first pressure sensor 43, a second pressure sensor 44, and a third pressure sensor 45. The first pressure sensor 43 may be associated with the suction manifold 14 and may be configured to output pressure data associated with the suction manifold 14. Similarly, the second pressure sensor 44 may be associated with the discharge manifold 16 and may be configured to output pressure data associated with the discharge manifold 16. Further, the third pressure sensor 45 may be associated with the cylinder 18 and may be configured to output pressure data taken from within the cylinder 18. Of course, any other pressure sensors 42 may be included to collect pressure data from other areas or elements of the pump 10.

In addition to the pressure sensors 42, the sensors 40 may further include accelerometer(s) 46, power source transmission sensors 48, and/or any other sensors 49. The accelerometer(s) 46 may be used, for example, to measure speed of the pump by monitoring speeds of one or more pistons 20. The power source transmission sensors 48 may, for example, be used in determining pump speed by providing transmission information from the power source 12, which may be used to derive speed information or derive any other information associated with the pump 10. As mentioned above, the sensors 40 may additionally include any other sensors 49 that are suitable for providing information from the pump 10 that may be useful in monitoring the health of the pump 10.

The data collected by the sensors 40 may then be transmitted, or otherwise communicated, to one or both of a field-programmable gate array (FPGA) electronic control module (ECM) 50 and a telematics ECM 60. Transmission of the data from the sensors 40 may be accomplished by any wired or wireless modes of communication between electronic devices (e.g., a hardwired connection, a wireless connection over a network, etc.).

Figure 4:
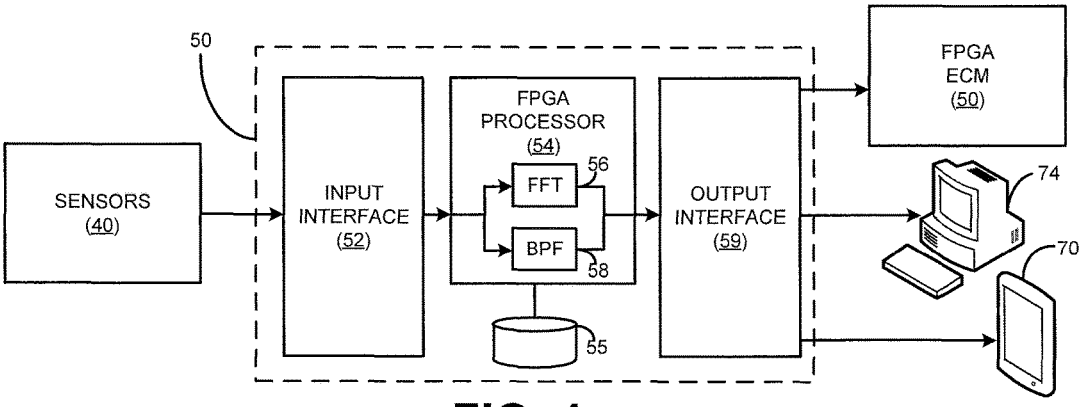
FIG. 4 is a schematic diagram of an exemplary FPGA controller for use with the system of FIG. 2, in accordance with the embodiment of FIG. 2 and the present disclosure.
Figure 5:
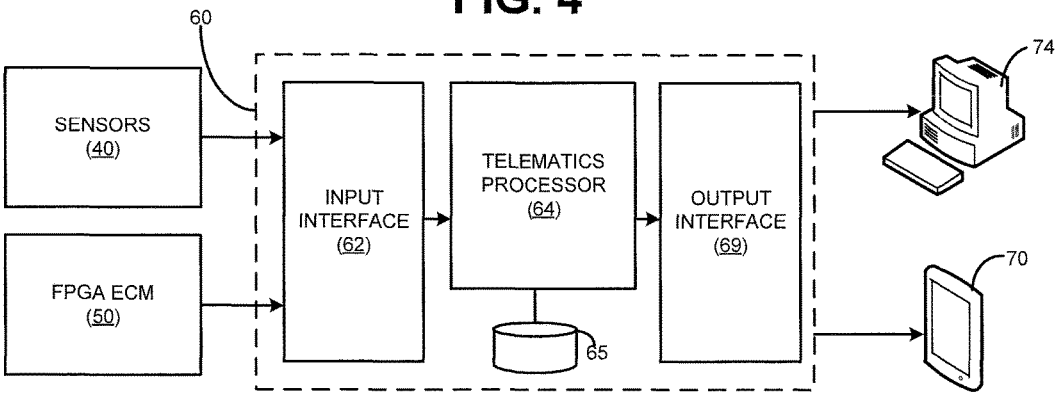
FIG. 5 is a schematic diagram of an exemplary telematics controller for use with the system of FIG. 2, in accordance with the embodiment of FIG. 2 and the present disclosure.

The FPGA ECM 50, which is illustrated in greater, schematic detail in FIG. 4, may receive the sensor data from the sensors 40 and process the data. The FPGA ECM 50 may be implemented as a controller or any suitable computing device having necessary components to process data. While the example FPGA ECM 50 is shown having an input interface 52, an FPGA processor 54 with an associated memory 55, and an output interface 59, the FPGA ECM 50 may include additional elements to accomplish the same or similar tasks, such as, but not limited to, the elements shown below in an exemplary computing device 100 in FIG. 6.

As mentioned above, the sensor data provided by the sensors 40, which may be received by the FPGA ECM 50 at the input interface 52, may include high frequency data. The FPGA ECM 50 may process the high frequency data to generate low frequency data, based on the high frequency data, which may be used by other computing devices, either on the worksite 32 or in a remote location. The FPGA ECM 50 may be especially equipped to process the high frequency data using, for example, the FPGA processor 54 which can utilize on-board frequency domain analysis capabilities.

An integrated circuit, processor, microprocessor, or the like, that is designed to be configured by a customer after manufacturing (hence, "field-programmable") may be used to implement the FPGA processor 54. Generally, an FPGA processor 54 contains an array of programmable logic blocks and a hierarchy of reconfigurable interconnects that allow the logic blocks to be configured as logic gates. Therefore, the user in the field can program the FPGA processor to function for a specific task, such as frequency domain analysis.

The FPGA processor 54 is specifically configured, and may be aided by executing instructions contained on the memory 55, to perform frequency domain analysis on the high frequency data to determine low frequency data based on the high frequency data. In some examples, the FPGA processor 54 may be configured to execute a fast Fourier transform (FFT) module 56, which may perform FFT analysis on the high frequency data to determine the low frequency data. The FFT module 56 may compute a discrete Fourier transform (DFT) of a sequence of the high frequency data to convert the high frequency data into the low frequency data. By converting the data signal's original high frequency data, in a time domain window, to frequency domain information and then extracting information from the frequency domain information, the low frequency data signal may be determined. In some examples, the determined low frequency data may include statistical information associated with the pump 10 at a selected frequency. Additionally or alternatively, the FPGA processor 54 may employ one or more bandpass filter(s) 58 to discretely convert the high frequency data to the low frequency data that includes the information at a selected frequency. Band pass filter(s) 58 may be specifically useful in targeting data at a specific frequency or in a specific frequency range.

The low frequency data is then provided to the output interface 59, which may include, but is not limited to including, any wireless connections, wireless transceivers, hardwired connection, and/or any other suitable mode of data communication. The output interface 59 may transmit or otherwise communicate the low frequency data to another controller associated with the pump (e.g., the telematics ECM 60) and/or to a monitoring party ("a monitor") which may use the low frequency data for monitoring health of the pump 10. For example, the low frequency data, after processing by the FPGA ECM 50, may be used to determine leakage in the pump based on pressure data from the pressure sensors 42.

The monitor may be, but is not limited to being, a mobile computing device 70, which may be located at the worksite 32 and may be used to monitor health of the pump 10 by an on-site operator 72. The mobile computing device 70 may be any suitable computing device and may, for example, include some or all of the elements of the exemplary computing device 100 of FIG. 6, as discussed below.

Additionally or alternatively, the monitor may be, but is certainly not limited to being, an off-site computing device 74 located at an off-worksite location 34, which may remotely monitor the pump 10 from a site that is any distance away from the worksite 32 (e.g., the off-worksite location 34). The pump 10 may be monitored, using the off-site computing device 74, by an off-site operator 76. Further, in some examples, the off-site computing device 74 may share the low frequency data with a database 78, which may be a database provided by a manufacturer of the pump 10. The database 78 may be used by the off-site operator 76 and/or an operator associated with the manufacturer of the pump 10 to monitor the health of the pump 10.

As mentioned above, the FPGA ECM 50 may transmit or otherwise communicate the low frequency data to the telematics ECM 60. The telematics ECM 60 may be any controller for processing low frequency data and may be implemented as a controller or any suitable computing device having necessary components to determine and/or share low frequency data. While the example FPGA ECM 50 is shown having an input interface 62, a telematics processor 64 with an associated memory 65, and an output interface 69, the FPGA ECM 50 may include additional elements to accomplish the same or similar tasks, such as, but not limited to, the elements shown in the exemplary computing device 100 of FIG. 6.

The telematics ECM 60 may use one or both of the low frequency data provided by the FPGA ECM 50 and additional low frequency data provided by the sensors 40 to provide health monitoring data to the same example monitoring parties discussed above with reference to the FPGA ECM 50. The telematics ECM 60 receives low frequency data from the FPGA ECM 50 and/or sensor data from the sensors 40 and may determine data to be transmitted to the monitor(s), using the telematics processor 64, and transmit the resultant pump health data to any of the monitors via the output interface 69.

Communication of data throughout the system 30 may be accomplished via a network 80. The network 80 may be any combination of wired or non-wired networks such as the Internet, a WLAN, a WAN, a personal network, or any other network for providing data communication and connection amongst two or more of the sensors 40, the FPGA ECM 50, the telematics ECM 60, the mobile computing device 70, the off-site computing device 74, and/or the database 78.

Figure 6:
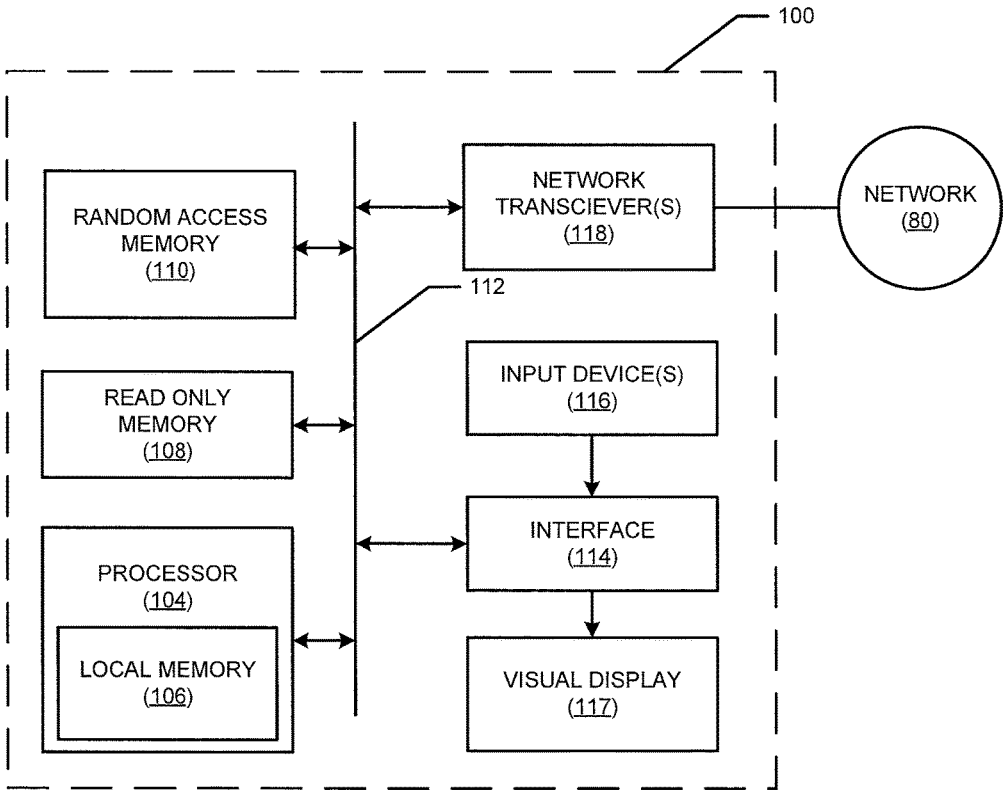
FIG. 6 is a schematic block diagram showing components of a computing device, which may be utilized to realize various computer-based components of FIGS. 2-5, in accordance with the present disclosure.

An additional, exemplary combination of hardware and software which may be used to implement one or more of the FPGA ECM 50, the telematics ECM 60, the mobile computing device 70, and the off-site computing device 74 is depicted schematically in FIG. 6. FIG. 6 is a block diagram of example components of the computing device 100, which is capable of executing instructions to realize elements of the disclosed systems and controllers described above in FIGS. 2-5. Further the computing device 100 may be capable of executing instructions to perform the methods discussed below in reference to FIG. 7. The computing device 100 may be, for example but not limited to, a mobile device, a tablet computer, a cellular phone, a laptop computer, a server, a personal computer, or any other type of computing device. The computing device 100 of the instant example includes a processor 104. For example, the processor 104 may be implemented by one or more microprocessors or controllers from any desired family or manufacturer.

The processor 104 includes a local memory 106 and is in communication with a main memory including a read only memory 108 and a random access memory 110 via a bus 112. The random access memory 110 may be implemented by Synchronous Dynamic Random Access Memory (SDRAM), Dynamic Random Access Memory (DRAM), RAMBUS Dynamic Random Access Memory (RDRAM) and/or any other type of random access memory device. The read only memory 108 may be implemented by a hard drive, flash memory and/or any other desired type of memory device.

The computing device 100 may also include an interface circuit 114. The interface circuit 114 may be implemented by any type of interface standard, such as, for example, an Ethernet interface, a universal serial bus (USB), and/or a PCI express interface. One or more input devices 116 are connected to the interface circuit 114. The input device(s) 116 permit a user to enter data and commands into the processor 104. The input device(s) 116 can be implemented by, for example, a keyboard, a mouse, a touchscreen, a track-pad, a trackball, and/or a voice recognition system. For example, the input device(s) 116 may include any wired or wireless device for providing input from the operator 24 to the computing device 100.

The visual display 117 is also connected to the interface circuit 114. The visual display 117 can be implemented by, for example, display devices for associated data (e.g., a liquid crystal display, a cathode ray tube display (CRT), etc.).

Further, the computing device 100 may include one or more network transceivers 118 for connecting to a network, such as the network 80, the Internet, a WLAN, a LAN, a personal network, or any other network for connecting the computing device 100 to one or more other computers or network capable devices. As such, the computing device 100 may be embodied by a plurality of computing devices 100.

As mentioned above the computing device 100 may be used to execute machine readable instructions. For example, the computing device 100 may execute machine readable instructions to perform one or more steps of the method shown in the block diagram of FIG. 7, which is described in more detail below. In such examples, the machine readable instructions comprise a program for execution by a processor such as the processor 104 shown in the example computing device 100. The program may be embodied in software stored on a tangible computer readable medium such as a CD-ROM, a floppy disk, a hard drive, a digital versatile disk (DVD), a Blu-ray disk, or a memory associated with the processor 104, but the entire program and/or parts thereof could alternatively be executed by a device other than the processor 104 and/or embodied in firmware or dedicated hardware.

INDUSTRIAL APPLICABILITY

In general, the present disclosure may find applicability in many industries, including, but not limited to, hydraulic fracturing and, more particularly, to systems and methods for monitoring pump health within a hydraulic fracturing system. The above described systems and the method discussed below may have particular value for gathering high frequency data associated with a pump at the worksite and converting the data, at the worksite, prior to transmission to a remote monitor.

Figure 7:
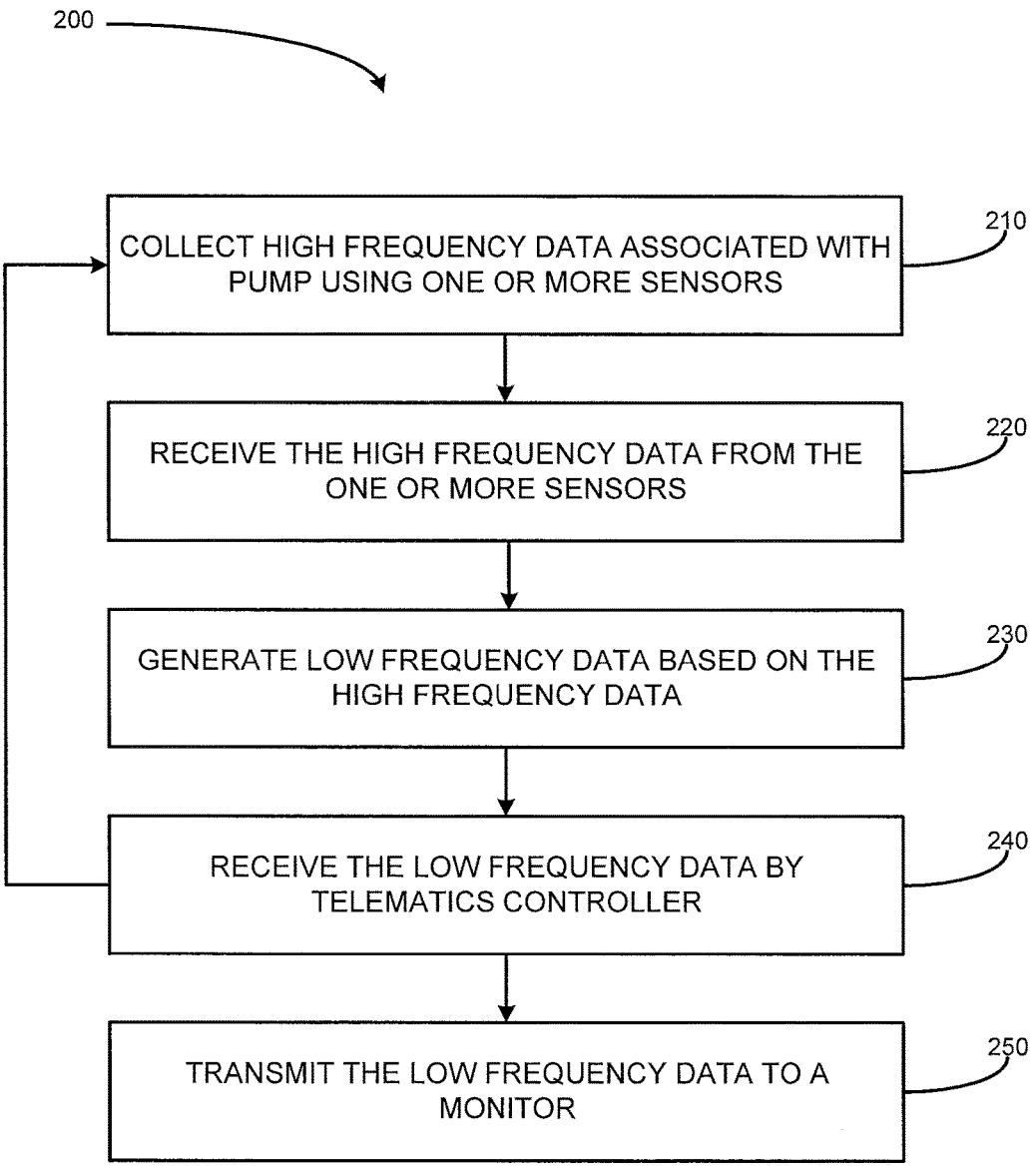
FIG. 7 is a flowchart depicting an exemplary method for monitoring a pump while the pump operates at a worksite, in accordance with another embodiment of the present disclosure.

Turning now to FIG. 7, a method 200, which may utilize elements of the system 30, for monitoring the pump 10 while the pump 10 operates at the worksite 32 is depicted as a flowchart. The method may begin at block 210, when the sensors 40 collect high frequency data associated with the pump 10. As detailed above, the sensors 40 may include one or more pressure sensors 42, which collect pressure data associated with the pump. The high frequency data collected by the sensors 40 may then be transmitted to and received by the FPGA ECM 50, as depicted in block 220.

At block 230, the FPGA controller may generate low frequency data based on the high frequency data received from the sensors 40. The low frequency data may be generated, based on the high frequency data, by utilizing on board frequency domain analysis capabilities of the FPGA controller, such as, but not limited to, the FFT module 56 and the bandpass filter module 58. The resultant low frequency data may then be output to the telematics controller 60.

By converting the high frequency data from the frequency domain to the time domain, at the worksite, using, for example, the FPGA ECM 50, frequency domain analysis does not need to be performed at a remote site (e.g., the mobile computing device 70, the off-site computing device 74, and the like). Software and/or hardware that can perform such analysis remotely, at quick enough speeds to rapidly monitor a pump, is cost prohibitive. For example, software to quickly perform FFT analysis to constantly monitor frequency domain data may be computationally complex, therefore requiring considerable time to code the software and requiring powerful hardware to execute such software. By providing frequency domain analysis at the ECM level by using, for example, the FPGA ECM 50 in conjunction with the telematics ECM 60, the high frequency data can be preprocessed by using frequency domain analysis to determine the low frequency data which reaches the monitor. Therefore, the need for expensive frequency-to-time domain analysis software at the remote site may be eliminated or reduced. Further, such use of the FPGA ECM 50 may dramatically increase the continuous data collection rate from a worksite to a monitor, while either eliminating or reducing the need to send a testing engineer to the worksite for high frequency data collection, which may also require additional data collection apparatus.

Returning now to FIG. 7 and the method 200, the telematics ECM 60 receives the output low frequency data, as described in block 240. The low frequency data is then transmitted to a monitor (e.g., the mobile computing device 70, the off-site computing device 74, etc.) by the telematics ECM 60. In some examples, the low frequency data may be communicated to a monitor via a wireless network (e.g., the network 80).

It will be appreciated that the present disclosure provides and systems and methods for scheduling maintenance services for earthmoving machines. While only certain embodiments have been set forth, alternatives and modifications will be apparent from the above description to those skilled in the art. These and other alternatives are considered equivalents and within the spirit and scope of this disclosure and the appended claims.

What is claimed is:

1. A system for monitoring a pump while the pump operates at a worksite, the system comprising:

one or more sensors associated with the pump and configured to collect high frequency data associated with operation of the pump and low frequency data associated with the operation of the pump;

a field-programmable gate array (FPGA) controller at the worksite configured to receive the high frequency data from the one or more sensors and configured to generate low frequency data based on the high frequency data using one or both of frequency domain analysis to implement a fast Fourier transform (FFT) algorithm and time domain analysis to convert the frequency domain data into time domain data as the low frequency data; and a low frequency controller at the worksite configured to receive the low frequency data from the FPGA controller, receive the low frequency data associated with the operation of the pump directly from the one or more sensors, determine a subset of the low frequency data from the FPGA controller and the low frequency data directly from the one or more sensors to be continuously transmitted to a monitor, and based on the determined subset of the low frequency data from the FPGA controller and the low frequency data directly from the one or more sensors to be continuously transmitted to the monitor, continuously transmit the determined subset of the low frequency data from the FPGA controller and the low frequency data directly from the one or more sensors to the monitor.

2. The system of claim 1, wherein the FPGA controller at the worksite generates the low frequency data based on the high frequency data using the frequency domain analysis to implement the FFT algorithm to convert the frequency domain data into time domain data for the low frequency data by utilizing on board frequency domain analysis capabilities of the FPGA controller at the worksite.

3. The system of claim 2, wherein the FPGA controller at the worksite implements a band pass filter to generate the low frequency data based on the high frequency data using the time domain analysis to implement the FFT algorithm to convert the frequency domain data into time domain data for the low frequency data.

4. The system of claim 1, further comprising a computing device configured to receive the determined subset of the low frequency data from the FPGA controller and the low frequency data directly from the one or more sensors from the low frequency controller and the determined subset of the low frequency data from the FPGA controller and the low frequency data directly from the one or more sensors to the monitor.

5. The system of claim 4, wherein the computing device is associated with either (i) one or both of an operator monitoring the worksite and a supplier of the pump or (ii) a mobile computing device operated by the operator monitoring the worksite at the worksite.

6. The system of claim 1, further comprising an off-site monitor configured to receive the determined subset of the low frequency data from the FPGA controller and the low frequency data directly from the one or more sensors from the low frequency controller at the worksite, wherein the off-site monitor is connected to a database associated with a supplier of the pump.

7. The system of claim 1, wherein the one or more sensors include one or more pressure sensors, each of the one or more pressure sensors operatively associated with the pump and configured to generate pressure data associated with the operation of the pump as the high frequency data associated with the operation of the pump.

8. The system of claim 1, wherein the pump is a hydraulic pump used in hydraulic fracking operations.

9. The system of claim 1, wherein the FPGA controller at the worksite is further configured to preprocess the high frequency data using the frequency domain analysis to implement the FFT algorithm to convert the frequency domain data into time domain data for the low frequency data, and wherein the low frequency controller at the worksite is configured to determine, based on the preprocessed, high frequency data, the subset of the low frequency data from the FPGA controller and the low frequency data directly from the one or more sensors to be continuously transmitted to the monitor.

10. The system of claim 1, wherein the FPGA controller at the worksite generates the low frequency data in a frequency range from 0 hertz to 100 hertz based on the high frequency data associated with the operation of the pump.

11. The system of claim 1, wherein the low frequency data associated with the operation of the pump directly from the one or more sensors includes statistical information associated with the pump at a particular frequency based on the high frequency data using the frequency domain analysis to implement the fast Fourier transform FFT algorithm to convert the frequency domain data into the time domain data as the low frequency data that includes statistical information associated with the pump at the particular frequency.

12. An apparatus comprised of an FPGA electronic control module (ECM) and a telematics ECM, that is operatively associated with a pump which operates on a hydraulic fracturing worksite, the apparatus comprising:

an input interface configured to receive input from one or more sensors, each of the one or more sensors associated with the pump and configured to collect high frequency data associated with operation of the pump and low frequency data associated with the operation of the pump;

a processor configured to receive the high frequency data from the input interface and generate low frequency data by utilizing one or both of frequency domain analysis to implement a fast Fourier Transform (FFT) algorithm and time domain analysis to convert the frequency domain data into time domain data as the low frequency data; and an output interface configured to receive the low frequency data from the processor, receive the low frequency data associated with the operation of the pump directly from the one or more sensors, determine a subset of the low frequency data from the processor and the low frequency data directly from the one or more sensors to be continuously transmitted to the monitor, and continuously transmit the determined subset of the low frequency data from the processor and the low frequency data from the one or more sensors to the monitor.

13. The apparatus of claim 12, further comprising a network transceiver configured to connect one or more of the input interface, the output interface, and the processor to a wireless network.

14. A method for monitoring a pump while the pump operates at a worksite, the method comprising:

collecting high frequency data associated with operation of the pump and low frequency data associated with the operation of the pump using one or more sensors;

receiving the high frequency data, using a FPGA controller at the worksite, from the one or more sensors;

generating low frequency data, using the FPGA controller at the worksite, based on the high frequency data using frequency domain analysis to implement a fast Fourier Transform (FFT) algorithm to convert the frequency domain data into time domain data as the low frequency data;

receiving the low frequency data, using a telematics controller, from the FPGA controller;

receiving the low frequency data associated with the operation of the pump, using the telematics controller, directly from the one or more sensors;

determining, using one or both of the telematics controller and the FPGA controller, a subset of the low frequency data from the FPGA controller and the low frequency data associated with the operation of the pump directly from the one or more sensors to be continuously transmitted to a monitor; and continuously transmitting the determined subset of the low frequency data from the FPGA controller and the low frequency data directly from the one or more sensors, using one or both of the telematics controller and the FPGA controller, to the monitor.

15. The method of claim 14, wherein said generating the low frequency data, using the FPGA controller at the worksite, based on the high frequency data using the frequency domain analysis to implement the fast Fourier Transform FFT algorithm to convert the frequency domain data into the time domain data as the low frequency data is performed by utilizing on board frequency domain analysis capabilities of the FPGA controller at the worksite.

16. The method of claim 14, further comprising continuously transmitting the determined subset of the low frequency data from the FPGA controller and the low frequency data directly from the one or more sensors to a computing device via a wireless network.

17. The method of claim 14, further comprising continuously transmitting the determined subset of the low frequency data from the FPGA controller and the low frequency data directly from the one or more sensors to a computing device at an offsite location via a wireless network.

18. The method of claim 17, further comprising communicating the determined subset of the low frequency data from the FPGA controller and the low frequency data directly from the one or more sensors to a database, using the computing device, the database being in operative association with the offsite location.

19. The method of claim 14, wherein said collecting high frequency data associated with the operation of the pump and the low frequency data associated with the operation of the pump using said one or more sensors includes collecting pressure data associated with the pump from said one or more pressure sensors of the one or more sensors, each of the one or more pressure sensors operatively associated with the pump.

* * * * *